US005271200A

United States Patent [19]

Witt

[11] Patent Number: 5,271,200

[45] Date of Patent: Dec. 21, 1993

[54] TITLE DISPLAY SYSTEM

[75] Inventor: Alvin E. Witt, West Chester, Pa.

[73] Assignee: PermaGrain Products, Inc., Media, Pa.

[21] Appl. No.: 887,293

[22] Filed: May 22, 1992

Related U.S. Application Data

[63] Continuation of Ser. No. 609,403, Nov. 5, 1990, abandoned.

[51] Int. Cl.[5] ..... E04B 5/00

[52] U.S. Cl. ..... 52/391; 52/DIG. 4; 52/385

[58] Field of Search ..... 52/385, DIG. 4, 391; 40/600, 621, 449

[56] References Cited

U.S. PATENT DOCUMENTS 3,341,996 9/1967 Jones et al. ..... 52/DIG. 4 X 4,663,874 5/1987 Sano et al. ..... 52/DIG. 4 X

FOREIGN PATENT DOCUMENTS 1573492 8/1980 United Kingdom ..... 52/DIG. 4

*Primary Examiner*—Carl D. Friedman

*Assistant Examiner*—Robert Canfield

*Attorney, Agent, or Firm*—Eugene E. Renz, Jr.

[57] ABSTRACT

A floor covering assembly, comprising:

a metallic subflooring covering a defined area of flooring, said subflooring being included in a larger area of flooring having a first pattern thereon; and a plurality of groups of tiles for covering said defined area, each group having a different particular pattern, said tiles comprising a laminated structure having a periphery and formed from a bottom layer having a face for contacting with said subflooring and magnetic means for covering the entire face of said bottom layer securing said tile to said subfloor, said bottom layer formed from an elastomeric material having magnetic particles embedded therein, a middle layer bonded to said bottom layer and having support means for providing structural integrity to said tile and for locating said particular pattern, and a top layer bonded to said middle layer and having a surface for accommodating pedestrian traffic, each of said group of tiles having different particular patterns to permit different patterns to be displayed on said flooring by selection of one of said plurality of groups of tiles, said tiles being of a size collectively in said defined area to define a gap between the tiles and surrounding flooring to permit selective removal of tiles from said defined area when desired.

1 Claim, 1 Drawing Sheet

TITLE DISPLAY SYSTEM

This is a continuation of our copending patent application for Tile Display System having Ser. No. 07/609,403, filed Nov. 5, 1990 now abandoned.

FIELD OF THE INVENTION

The present invention relates to a floor covering assembly. More particularly, the invention relates to an assembly of floor tiles which permits a message or display to be presented on an area of a floor. The floor has the appearance of a permanent flooring but is removable under appropriate circumstances to permit a change in the display or other information which the tiles present to persons walking in the area.

BACKGROUND OF THE INVENTION

Over the years, one of the most successful floor covering products has been vinyl tile flooring. The tile is long wearing and attractive, particularly when clear vinyl is laminated over wood or other decorative and eye pleasing scenes and materials. A laminate containing clear vinyl over a design, with additional vinyl and an adhesive system, allows for the mounting of vinyl tile on subfloors. These tiles are ideally suited for high traffic areas. It is essential to present a very favorable impression to consumers as they enter a store, beginning with clean and polished floors. Vinyl tile is presently the best floor covering assembly when factors such as cost, permanence, cleanliness, appearance, and durability are all considered. For that reason, vinyl tile is the preferred floor for a wide variety of stores, restaurants and other establishments.

Typical vinyl tile which is commercially available is extremely difficult to remove once it has been installed. Typically, removal requires workers to dig up the floor using a chisel to remove the tile, and then apply a patching material Because the patching must dry, a 24 hour waiting period is necessary. Then the crew returns and the subflooring can be prepared and new tile installed. This is an extremely expensive process, is very unsightly, and calls for significant down time for the particular area of the flooring. Up until the present time, it has not been possible to change the design of a floor covered with vinyl tile without this expense and inconvenience.

One alternative which has been proposed is to provide exterior designs which are placed on top of already existing vinyl tile. This alternative presents several significant difficulties. First, if the design is to be permanent and have the strength, resilience and durability of vinyl tile, it must have the same permanence of mounting. Thus, when the message or design is to be changed, the same difficulties in removing an overcoating of some form is realized as would be with the tile originally on the floor area. If the surface pattern is not as durable as vinyl tile, then ordinary pedestrian traffic will disturb or destroy the coating, and at the least make it quite unsightly in a relatively short period of time. Thus, continued replacement and repair increase costs prohibitively. Finally, there is a danger that any floor covering which is significantly different in height, for example, than the adjacent area will present special risks and hazards to unsuspecting pedestrians.

Accordingly, it is an object of this invention to provide a floor covering assembly which permits a defined area to be conveniently removed and replaced with alternative floor covering.

Another object of the present invention is to provide a safe, stable, highly resistant floor covering which can be removed at will and replaced with similar flooring and yet which can be left on the floor for extended periods of time without concern for durability, eye appeal or other factors.

Other objects will appear hereinafter.

SUMMARY OF THE INVENTION

It has now been discovered that the above and other objects of the present invention may be accomplished in the following manner. Specifically, a unique floor covering assembly has been devised which includes a metallic subflooring covering a defined area, used in combination with a plurality of vinyl tiles which are removably bonded to said subflooring. The tiles have a particular pattern thereon, which may be clear, solid color, writing, pictures, or any other design or decoration that may be most appropriate for the situation.

The vinyl tiles of the present invention comprise a laminated structure formed from a bottom layer for contact with the subflooring and having magnetic means for removably bonding said tile to said subfloor, a middle layer having support means for providing structural integrity to the tile, and a top layer having a surface for accommodating pedestrian traffic.

In the preferred embodiment, the floor covering assembly of this invention further includes a larger area of flooring including the defined area, with the larger area having a first pattern which is different from a particular pattern of the tiles forming the covering assembly of this invention. Preferably, the particular pattern advertises a product or service.

The preferred tile of this invention is approximately one-eighth inch in thickness and will be thinner than the tiles in the surrounding area. The surrounding area will include floor tiles which are applied directly to a subfloor such as a concrete slab. The present invention contemplates a metallic subflooring on the concrete slab, so that the plurality of vinyl tiles positioned on the metallic subfloor will need to be thinner by approximately the thickness of the metallic plate in order to present a uniform thickness and smooth floor.

The bottom layer of the tile is preferably comprised of a magnetic material embedded in rubber, such as magnetic particles which have been dispersed in elastomeric material such as natural or synthetic rubber. This bottom layer is glued to the middle layer.

The middle layer includes a structural integrity increasing material such as fiberglass or other structural aids, along with a quantity of vinyl. On top of the structural integrity increasing material, such as fiberglass, is a pattern which will remain visible once the top layer of clear vinyl is placed over it. Vinyl layers will normally bond to one another without glue or adhesive.

The bonded, laminated tiles are placed on the metallic subflooring so that the message is plainly visible to pedestrians. The particular message which can be placed on tiles of the present invention is limited only by the imagination and resources of the advertising or display program. For example, different products or services can be advertised, aided by direct reference to the product or by the creation of an image such as, by way of example, an oasis in a desert.

In any event, the floor covering assembly of the present invention provides all of the advantages of vinyl floor tile coverings, including cleanliness, low cost, durability, and long lasting appearance. At the same time, the flexibility of multiple product and multiple feature advertising programs is now available for the first time with all of the advantages of vinyl tile.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
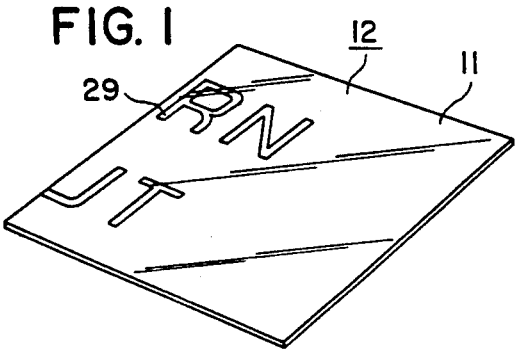
FIG. 1 is a perspective view showing the upper face of a magnetized floor tile that is constructed and utilized in accordance with the present invention.
Figure 2:
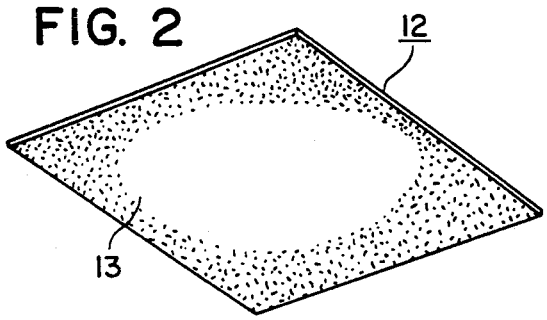
FIG. 2 is a perspective view showing the bottom surface of the floor tile shown in FIG. 1.

As shown in FIGS. 1 and 2, the tile of the present invention, shown generally by reference numeral 12, includes a top 11 which may contain a particular pattern 29. Tile 12 has a bottom 13 which is suitable for bonding to a steel plate or other metallic subflooring which is capable of being removably bonded to magnetic materials.

Figure 3:
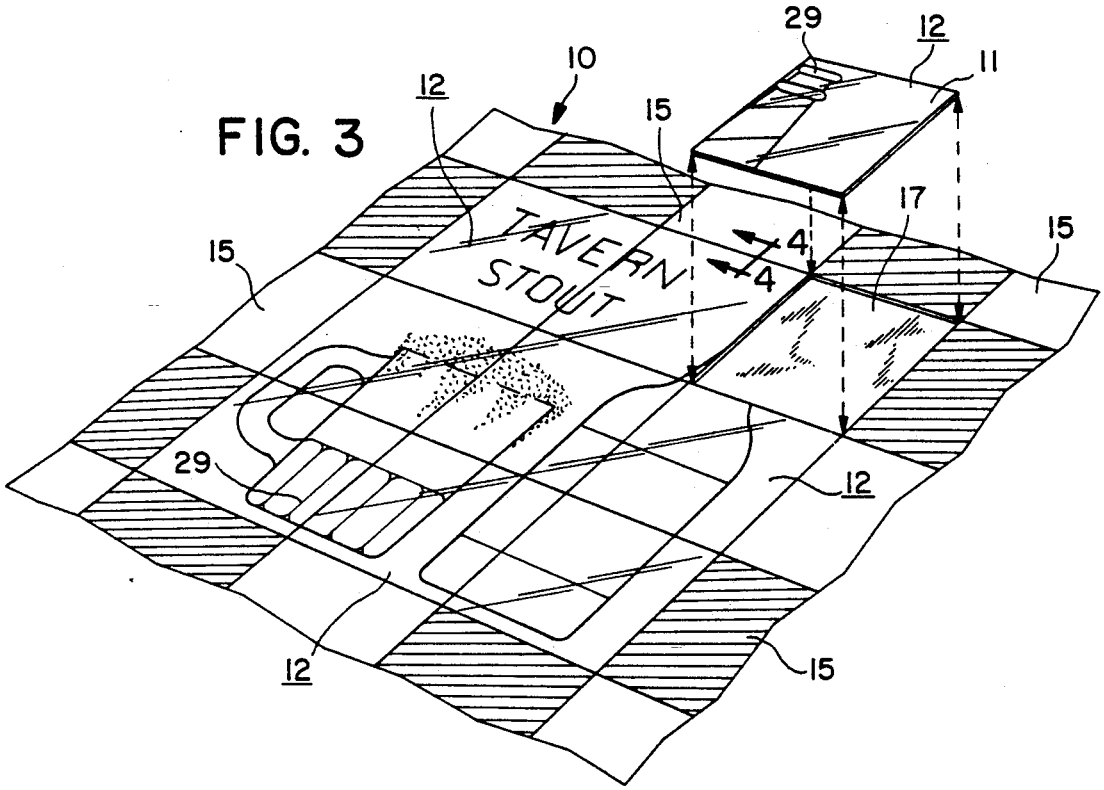
FIG. 3 is a fragmentary perspective view of a conventionally tiled floor that frames a surface area that has been prepared to accept multiple tiles such as shown in FIGS. 1 and 2, with those tiles forming a temporary advertisement that can be changed quickly and with a minimum of time and labor.

As shown in FIG. 3, the tiles 12 of the present invention are placed in a defined area, which area is defined in this case by adjacent ordinary tiles 15. Ordinary tiles 15 are permanently adhered to flooring 19 by an adhesive 21. The area over which the floor covering assembly of the present is to be applied is covered by a magnetic plate 17, which, in FIG. 3 shows an area covered by nine tiles.

Each of the tiles 12 bonds directly to the metallic subflooring 17 by magnetic attraction between the steel floor 17 and magnetic particles which are dispersed in the underside layer 13.

Figure 4:
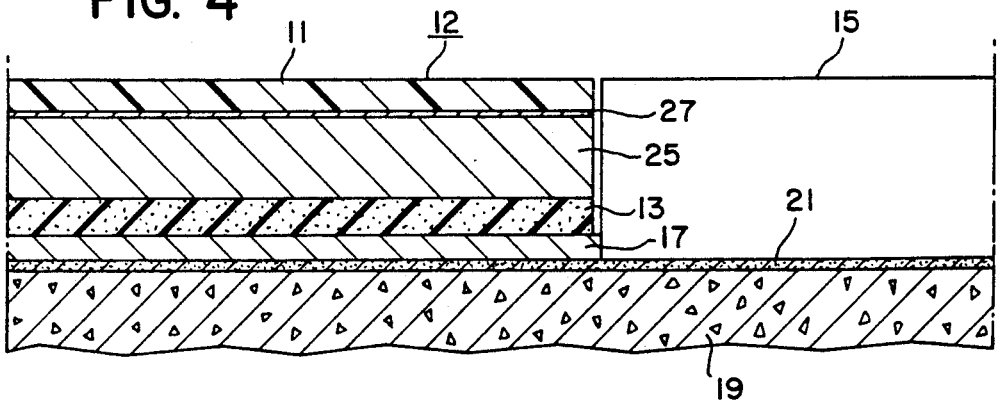
FIG. 4 is a greatly enlarged sectional, elevational view taken along the line 4—4 of FIG. 3, illustrating details of the removable tile and the laminar construction of the tile of this invention.

In a greatly enlarged sectional elevational view, shown in FIG. 4, it can be seen that the tile 12 is a laminated structure. The laminated structure includes a bottom layer 13 which is positioned onto the subflooring 17 for removably bonding the tile 12 to the subfloor 17. The bottom layer 13 is formed from a elastomeric material such as rubber in which is embedded a magnetic means, such as a plurality of magnetic particles, which cause the attraction between the bottom 13 and the subfloor 17.

The rubber layer 13 is glued to a middle layer 25 which may be formed from a plurality of layers of vinyl and which is intended to provide structural integrity to the tile. One typical form of middle layer 25 includes several layers of vinyl in which is embedded fiberglass or other structural integrity increasing material. This layer is conventional and a variety of vinyl and reinforcing material combinations are presently known. Above the middle layer 25 is a thin layer on which the pattern 29 has been printed. Photographs placed on paper stock are typically used to produce a pattern 29 with the particular advertisement of product or services printed thereon. The top layer 11 comprises a clear vinyl which is functionally the same vinyl which is used in conventional tile 15.

Preferably, conventional tile 15 and the top 11 of tile 12 are in the same plane, so that the smooth tile surface is uninterrupted. The force of the magnetic particles embedded in the rubberized layer 13 and the metallic subflooring 17 is sufficient to hold the tile 12 in place. Nevertheless, when it is desired to change the pattern 29, a spatula or other thin strong instrument is placed between tile 15 and tile 12, thereby allowing the tile 12 to be removed by breaking the magnetic attraction between the magnetic particles in layer 13 and the subflooring 17. Instead of a day and a half of down time to replace the tiles 12, a quick change of the advertising or other form of display can be accomplished in a matter of minutes.

While particular embodiments of the present invention have been illustrated and described herein, it is not intended to limit the invention and changes and modifications may be made therein within the scope of the following claims.

What is claimed is:

1. A floor covering assembly, comprising:

a tile floor assembly for application to a flooring, a metallic subflooring covering a defined area of said flooring;

a first group of flooring tiles covering the flooring in abutting edge to edge array in a pattern surrounding said predetermined defined area;

said first group of flooring tiles being permanently adhered to said flooring by an adhesive;

a second group of tiles comprising a laminated structure having magnetic means for removably applying said second group of tiles to said metallic subflooring covering said predetermined floor area and having an advertisement on one face thereof and covering said metallic subflooring covering said predetermined area in abutting edge to edge relation; and said second pump group of tiles spaced from said first group to define a small gap therebetween for ease of removing the advertising tiles when desired.

* * * * *